US006149305A

United States Patent [19]

Fier

[11] Patent Number: 6,149,305

[45] **Date of Patent: *Nov. 21, 2000**

[54] WATERPROOF CONTAINER AND METHOD

[76] Inventor: Alyx T. Fier, P.O. Box 29789, Seattle, Wash. 98118

[ * ] Notice: This patent issued on a continued prosecution application filed under 37 CFR 1.53(d), and is subject to the twenty year patent term provisions of 35 U.S.C. 154(a)(2).

[21] Appl. No.: 09/239,230

[22] Filed: Jan. 29, 1999

Related U.S. Application Data

[60] Provisional application No. 60/073,199, Jan. 30, 1998.

[51] Int. Cl.[7] ..... B65D 33/24; B65D 30/08

[52] U.S. Cl. ..... 383/91; 383/85; 383/107; 383/113

[58] Field of Search ..... 383/91, 89, 88, 383/85, 83, 82, 101, 113, 107

[56] References Cited

U.S. PATENT DOCUMENTS

| | | | |
|---|---|---|---|
| 1,978,257 | 10/1934 | Gardiner | 383/107 X |
| 1,993,394 | 3/1935 | Bangs et al. | 383/82 |
| 2,423,889 | 7/1947 | Hurt | 383/113 X |
| 3,695,507 | 10/1972 | Sams | 383/107 X |
| 5,074,300 | 12/1991 | Murphy | 383/107 X |
| 5,730,530 | 3/1998 | Stoddard et al. | 383/113 |
| 5,931,583 | 8/1999 | Collie | 383/89 |

FOREIGN PATENT DOCUMENTS

| | | | |
|---|---|---|---|
| 1552810 | 9/1979 | United Kingdom | 383/113 |

*Primary Examiner*—Jes F. Pascua
*Attorney, Agent, or Firm*—Robert B. Hughes; Hughes & Schacht, P.S.

[57] ABSTRACT

A waterproof bag having three layers, namely inner and outer layers made of a rather durable non-waterproof fabric, and an intermediate layer that is positioned between the inner and outer layers so as to be protected from sharp objects and the like. The bag has an upper circumferencial edge defining a bag opening, and the upper edges of the three bag layers are sewn together. There is a moderately stiff closure belt or strap at the upper portion of the bag. When the bag is to be closed in its waterproof containing position, the belt or strap and the upper portion of the bag is folded over several times, and the outer ends of the belt are brought together to form a loop. This provides a substantially waterproof container. The container is also shown as a containing section of a backpack.

22 Claims, 8 Drawing Sheets

WATERPROOF CONTAINER AND METHOD

This application claims the benefit for provisional application Ser. No. 60/073,199 filed Jan. 30, 1998.

The present in invention relates to a waterproof container, or container system and also a related method, and more particularly to a waterproof bag, backpack or the like or other container system which can conveniently be used in camping or other activities where the container may be exposed to water or submerged in water, and yet is convenient to use.

BACKGROUND OF THE INVENTION

In camping, backpacking, or other outdoor activities, there are various items which should not be exposed to water (e.g. a camera, maps, first aid kit, a cell phone, etc.), and yet these items should be readily accessible to the user. Thus, there is a need to be able to place such items in a waterproof container which is "user friendly", in that it can be easily opened and closed, and yet which provides protection from the water.

In the prior art, there are various waterproof bags where the bag material is given a treatment to make it waterproof. However, this can often be expensive. Also, in outdoor activities, the container can be subjected to sharp objects, impacts, and other forms of abuse, which may damage the waterproof material so that it leaks. A search of the U.S. patent literature disclosed a number of waterproof bags or containers, and also various devices for closing these and other bags. These are as follows:

U.S. Pat. No. 2,435,743 (Geimer) discloses a bag made of three components. There is an outer layer 2, which is formed of a sturdy general-purpose material, and this is not water impervious. There is a second intermediate bag 3 which is made of a waterproof material, and an inner bag component 10 which is formed of porous sheet stock. The reason given for this construction of the inner bag 10 is so that air which is mixed with the material contained in the inner bag 10 can pass out from it in all directions. These bag components are not attached to one another, and the upper end of each is closed separately.

The manner of closing the bag is probably best seen in FIGS. 5 and 6. The innermost bag component 10 is closed by being folded over on itself, as shown in FIG. 5. Then the upper edge of the intermediate waterproof bag is closed in the manner shown in FIG. 4 in one view, and also shown in FIG. 5 in a sectional view taken along line 5—5 of FIG. 4. The upper portion of the intermediate waterproof bag component 3 is then folded over on itself in a manner shown in FIG. 6, and the outer bag 2 is sealed as shown in FIG. 7.

U.S. Pat. No. 4,421,150 (Masters) shows a bag system in which there is a sturdy outer bag "B" of heavy duty nylon or the like, and there is a waterproof inner bag "D". There is a flap "C" secured to the outer bag and this overlaps the end portion of the bag "D". In use, the upper end of the inner bag "D" is rolled as shown in FIG. 3, and then the flap "C" is folded over and secured with a Velcro strap.

U.S. Pat No. 3,315,877 (Grevich) shows a bag that may or may not be provided with an air tight liner (column 1, lines 47 and following). The bag is closed by folding over the lip several times and binding it with a locking strip 18, which would be more similar to your method of closing the bag.

U.S. Pat. No. 3,203,551 (Van Loan) shows a bag closure in which the open end is folded over and secured by a Velcro band that folds around the edge of the bag.

U.S. Pat. No. 4,550,442 (Lepisto) shows a seamless plastic tube placed in a gusseted bag and free to move about.

U.S. Pat. No. 4,343,158 (Campbell) shows a multi-pocket bag with insulated sections for the storage of insulin and other supplies, as well as a pocket for an ice pack or the like.

U.S. Pat. No. 3,674,188 (Anderson) shows a game bag which a burlap bag contains a waterproof bag that holds the game. There are opening in the waterproof bag that holds the game. There are openings in the waterproof bag for drainage, rather that being watertight.

U.S. Pat. No. 2,580,796 (Kleiss et al.) shows a shopping bag that is provided with a moisture proof liner that is secured at only the top which can be pulled completely from the bag.

U.S. Pat. No. 1,982,813 (Jacobi) shows a bag that is closed by rolling over the top, and binding the overlapping layers with a strap. The strap is retained by a lock that passes through openings in the over lapping flaps.

U.S. Pat. No. 1,742,808 (Reach) shows a water bag that is sealed by folding over the top several times, and binding the folded mass with an attached strap.

U.S. Pat. No. 825,455 (Mortensen) shows a bag that is held closed by winding the top of the bag around a length of a flexible strip, which is then joined to itself.

U.S. Pat. No. 814,150 (Manahan) shows a closure system in which the ends of the bag are clamped after being folded over so as to seal the bag.

SUMMARY OF THE INVENTION

Accordingly, it is an object of the present invention, to provide such a bag or container which meets these needs, namely that it is convenient, and "user friendly", relatively inexpensive, and yet can effectively protect various contained objects from contact with water. The container unit of the present invention is particularly adapted for use in camping and backpacking or the like, but also is capable of being used for other situations or activities. The container unit comprises the following.

There is a flexible container comprising a containing wall that has a side wall portion and a bottom wall portion closing the side wall portion. The side wall portion has an upper edge portion defining an upper containing opening.

The container wall comprises three layers, each of which has an upper edge portion, the upper edge portions of each of the three layers being joined to one another. The three layers comprise:

i. an outer flexible and durable first layer at an exterior surface of the container;

ii. an inner flexible durable second layer at an interior surface of the container;

iii. an intermediate waterproof third layer positioned between the first and second layers.

The container wall comprises a lower containing wall section defining a containing chamber and an upper closure wall section comprising front and rear upper wall portions that can be positioned against one another. The closure wall section comprises a plurality of closure wall sub-sections extending across the upper closure wall section with adjacent sub-sections being capable of one being folded downwardly relative to the other about an intermediate folding portion so as to be in a folded configuration where interior surface portions of the front and rear upper wall portions press against one another in sealing relationship.

There is a closure retaining device having a retaining position to retain the closure wall sub-sections in their folded configuration.

Other features will be apparent from the following detailed description.

DESCRIPTION OF THE PREFERRED EMBODIMENT

The container unit of the present invention can be in the form of a bag or a pouch that could function as a separate item, possibly having a handle strap attached to it or a carrying strap by which the bag or pouch could be carried around a person's waist. Also, the container unit could be incorporated in a backpack or other system. In the following text, the container unit 10 will be first described in its simplest configuration, where it functions simply as a flexible bag to contain the desired items (such as a camera) in a waterproof environment. In this initial part of the description, the container unit 10 will be referred to bag "10", with the understanding that the basic concept of the present invention is sufficiently broad so that it would also be intended to include (within its broader scope) container units which would not be considered to be a "bag" in a conventional sense.

After the initial description of the bag 10 and also the method of using the same, there will be a more detailed analysis of the function of the bag providing a waterproof containment. Then there will be a description of a second embodiment and then the container unit of the present invention incorporated in a backpack.

Figure 1:
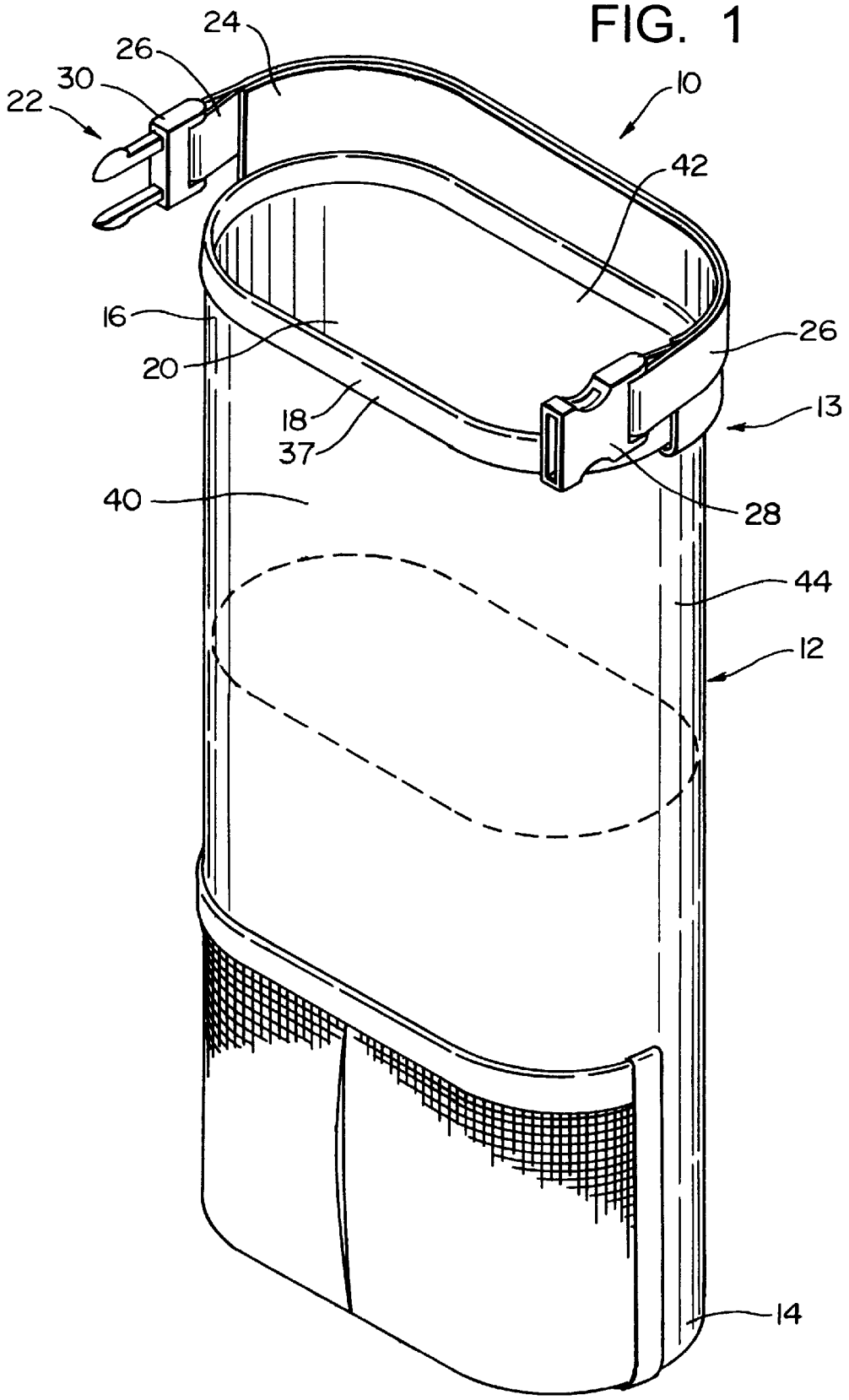
FIG. 1 is an isometric view of a first embodiment of the container of the present invention, in the form of a small carrying bag.
Figure 2:
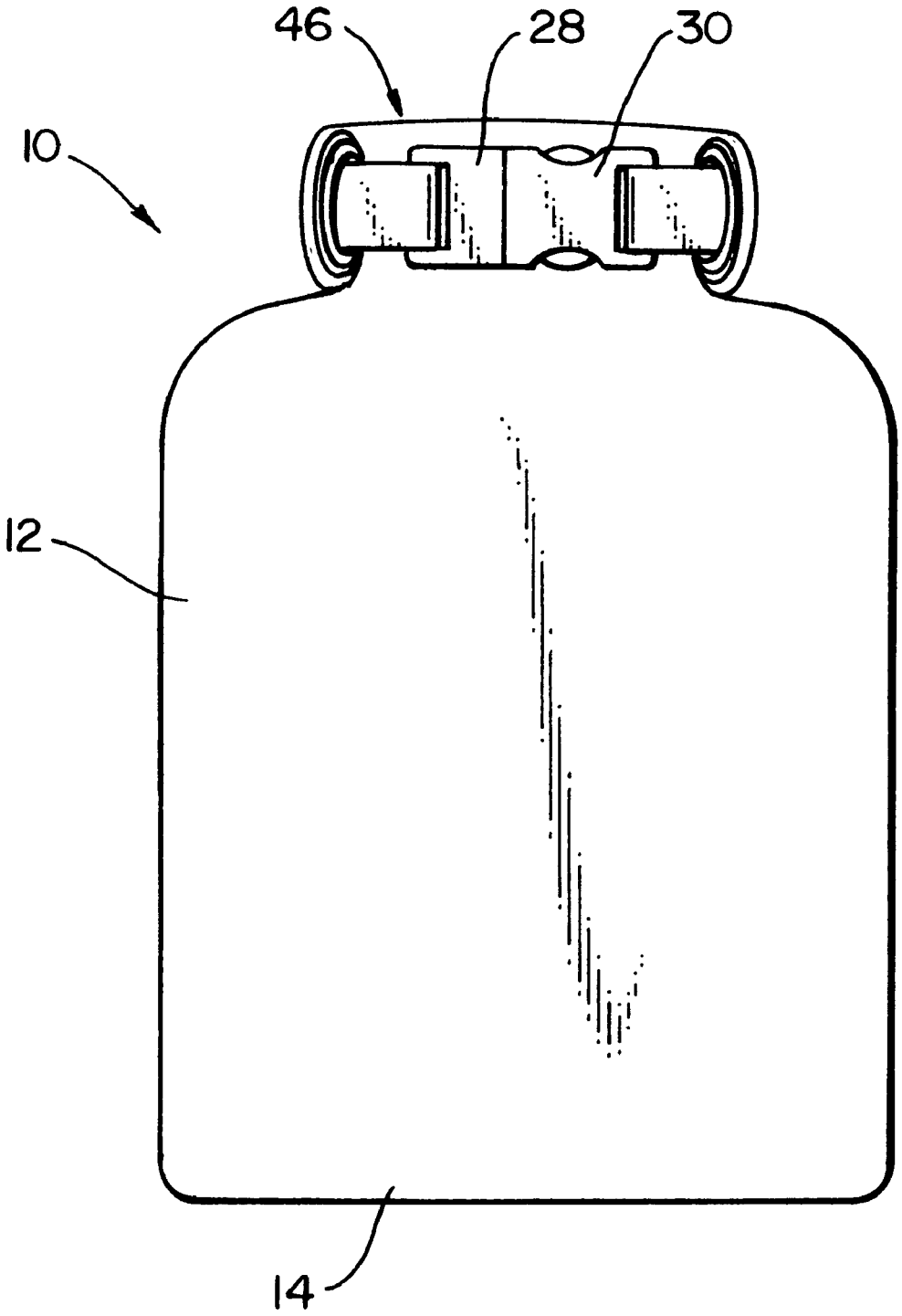
FIG. 2 is a front elevational view of the bag of FIG. 1.
Figure 3:
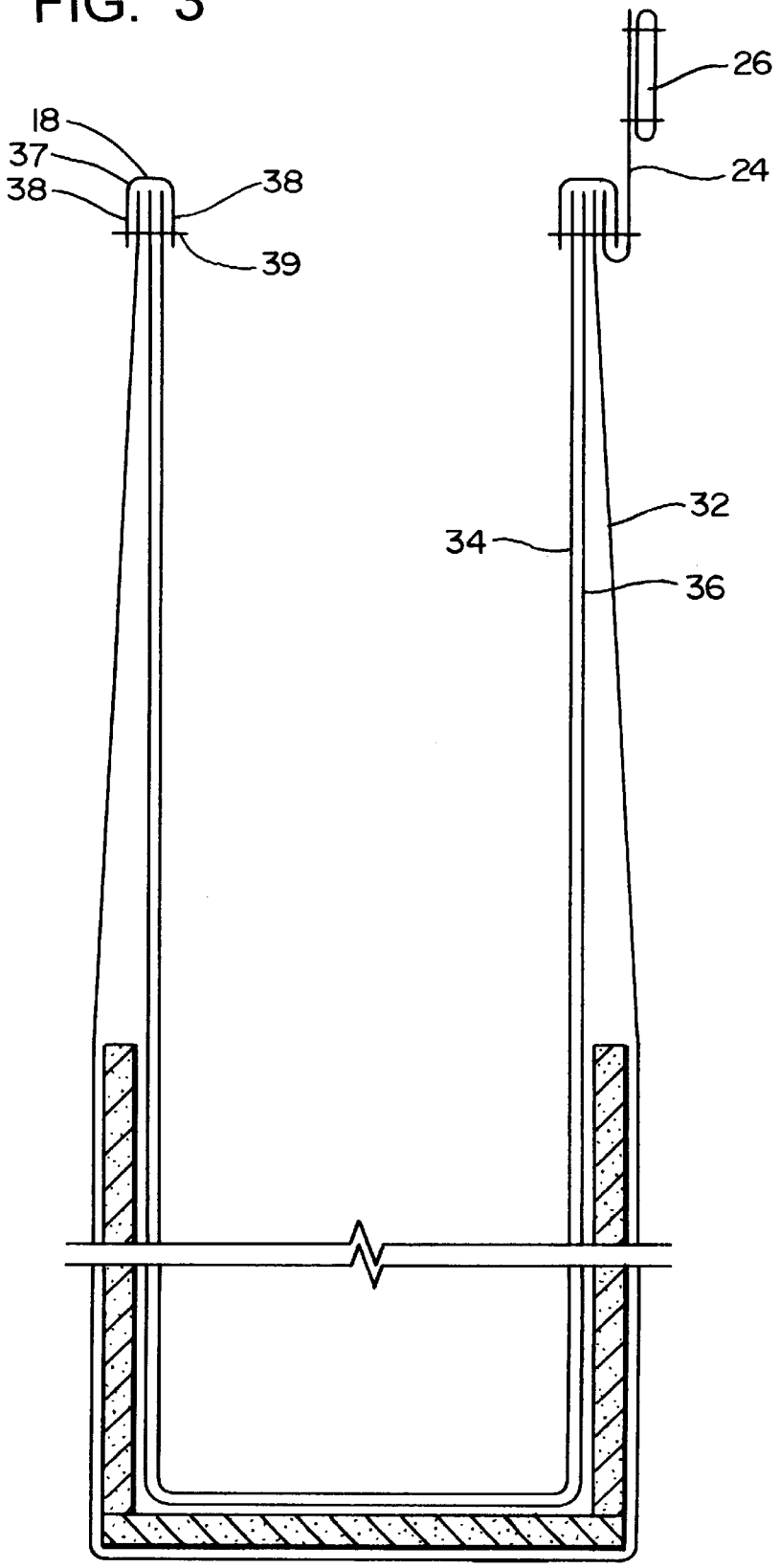
FIG. 3 is a sectional view along line 3—3 of FIG. 2, with some components of the bag being shown somewhat schematically.

In FIGS. 1–3 there is shown a container in the form of a bag 10 having a containing section 12, a closure section 13, a lower end 14 and an upper end 16. The bag 10 is formed with an upper edge portion 18 that defines a bag upper opening 20. At the upper end 1 6 of the bag, there is a closure device generally designated 22, which comprises a flap 24 and a moderately stiff closure belt 26 sewn or otherwise attached to the flap 24. The closure belt is provided with a two-part connector, these parts being designated 28 and 30, and being connected to opposite ends of the closure belt 26.

With reference to FIG. 3, it can be seen that the bag 10 is made up of three bag components or layers, all of which have the overall shape of the bag 10, and thus have substantially the same configuration.

First there is an outer bag component or layer 32 made of durable flexible material (e.g. a canvas like material or other durable fabric or material), and an inner bag component 34 also made of a durable material. These two bag components 32 and 34 do not need to be waterproof, and normally are not waterproof. Then there is an intermediate bag component 36 which is made of a waterproof material, but which is not (in the preferred embodiment) made of highly durable material. In the preferred embodiment, the intermediate bag component 36 is made from a flexible plastic sheet material, such as material which is commonly used for smaller articles (e.g. food or general merchandise).

Each bag component 32, 34 and 36 is made in a general bag-like configuration, having front, back, side and bottom panels all joined together. Each can be made as an integral flexible structure or as pieces bonded, sewn, or otherwise joined to one another. The intermediate waterproof bag component 36 is normally made as one integral flexible piece of plastic sheet material.

The upper edges of all three bag components 32, 34 and 36 are sewn together (see FIG. 1) to form the upper edge portion 18 of the bag 10. As can be seen in FIGS. 1 and 3 in this particular embodiment a binding strip 37 is placed over the upper edges of the bag layers 32, 34 and 36, and folded along its longitudinal center line into a u-shaped cross-section to fit over the upper outside surface portions of the outer and inner layers 32 and 34. The two sides 38 of the strip, the layers 32,34 and 36, and the strip 24 are sown together by means of thread, this being indicated schematically by the broken lines 39 to press the upper edges of the sides 38 and the layers 32, 34, and 36 against one another.

To explain the manner in which the upper closure section of the bag 10 is moved into its closed position, reference is made to FIGS. 4A–4E. The upper perimeter edge 18 of the bag is shown as a rectangle, and the front and rear walls 40 and 42 are simply shown as straight lines. However, it is to be understood that each of these walls 40 and 42 comprises the three bag components or layers 32, 34 and 36.

Figure 4A:
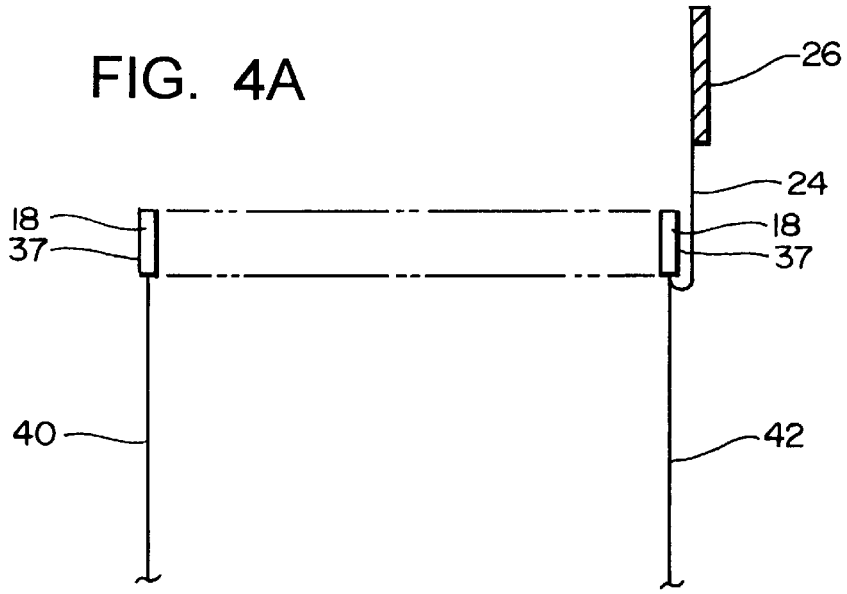
FIG. 4A–4E are five figures showing in sequence the steps in closing the bag of the first embodiment of FIGS. 1–3.
Figure 4B:
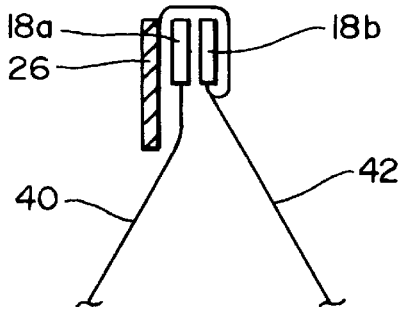

In operation, the bag is used as follows. When the bag 10 is in its fully open configuration, the front and back walls 40 and 42, respectively, and side walls 44 are formed in a somewhat rounded or generally rectangular configuration. The item or items which are to be stored are inserted through the upper opening 20 and lowered into the main containing portion 12 of the bag 10. Then, as shown in FIGS. 4A and FIG. 4B, the upper edge portion 18 of the bag 10 has the front portion thereof moved against the back portion thereof so that the entire upper edge portion 18 becomes formed as an upper front edge portion 18*a* and an upper rear edge portion 18*b* which are pressed against one another, as shown in FIG. 4B. Also, as shown in FIG. 4B, in the belt or strap 26 is then folded downwardly to the position of FIG. 4B so that the belt 26 is positioned parallel to and against the upper bag portions.

Figure 4C:
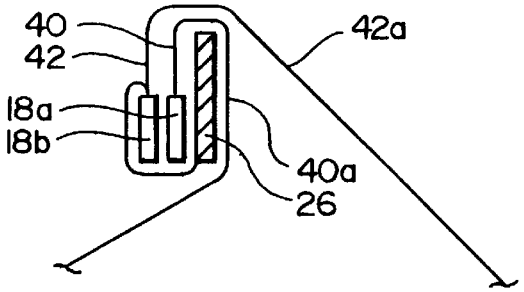
Figure 4D:
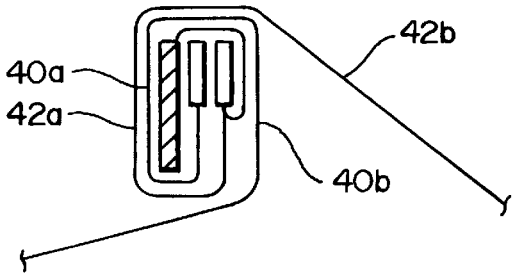

From the position of FIG. 4B, the belt 26 and the upper bag edge portion are rotated downwardly 180 degrees to the position of FIG. 4C so that the belt 26 is positioned against an upper portion of the front wall 40. Then the belt 36 is rotated through a 180 degree rotational path of travel two more times to arrive first at the position of FIG. 4D and then at the position of FIG. 4E.

Figure 4E:
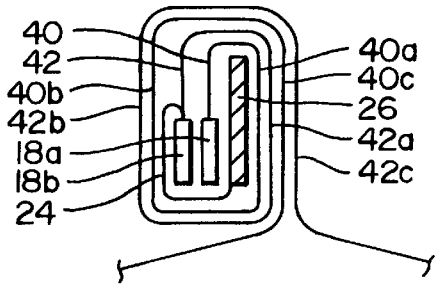

With the bag 10 in the position of FIG. 4E, the two end portions of the belt 26 are pulled forwardly and toward on another in a manner to form a loop, and the two end connector parts 28 and 30 are joined so that the bag 10 is shown in the configuration as shown in FIG. 4. The portion of the bag which has been folded over on itself and then positioned in a somewhat circular curve as shown in Figure is generally designated 46. The inside circumferential portion 44 of this rolled up portion 46 is caused to be in compression, and the outer circumferential portion of the folded up portion 46 is placed in tension. As will be explained later herein, this enhances the forming of the water tight sealing of the open end of the bag 10. With this occurring, the closure of the bag 10 has been accomplished.

It should be pointed out that this particular technique of closing the top end of a bag is already known in the prior art, and there are commercially available containers that utilize such a belt closure mechanism. However, in the arrangement of bag 10 in the present invention, it was found to work quite well.

With the bag upper end portion folded over and with the connectors in connecting position, as shown in FIG. 2, the upper end of the bag is now in a securely closed so as to be watertight, with the intermediate bag component 36 providing a waterproof barrier to prevent water or other liquid from entering into the bag. It has been found in use that if the bag is subjected to direct contact with water under pressure for an extended period of time, that a certain amount of moisture may migrate into some of the seams formed by the folded closure portion 46 of the bag and into the bag interior. However, this takes a rather long time, and is very minor, in most all instances it has been found to be negligible or non-existent. For all practical purposes, the bag is waterproof for its intended uses in use in camping, etc.

A particular advantage of the present invention is that the inner and outer bag components 32 and 34, respectively, being made of a very durable material are very wear resistant, protect the intermediate water proof bag component from any sharp objects or other abuse. Both are made of a nylon fabric. The outer layer 32 is made as 500 Denier nylon, and the inner is desirably made as 500 Denier or less. It could be as high as 1000 Denier, but present analysis indicates that it should desirably be lower.

Also, since there is no necessity to make the inner and outer bag components 32 and 34 waterproof, these can be made much more cheaply. In addition, since the intermediate layer 36 is not subjected to abuse, it can be made of a waterproof material which is rather inexpensive, such as a flexible plastic sheet material commonly used in flexible bag-like containers.

Also, as another feature since the inner and outer bag components 32 and 34 need not be waterproof, they can have various straps, pockets, labels, etc. sewn into the outer or inner bag components 32 and 34. In prior art bags where the main bag itself is made of waterproof material, sewing such items to the bag would cause leak.

Another advantage is that the inner and outer bag components 32 and 34 can be made inexpensively by sewing one or more pieces of durable fabric into the bag configuration. Since there is no need for waterproofing this inner and outer component 32 and 34, this makes the manufacturing process less expensive.

It was indicated earlier in this text that after the general description given above, there would be a discussion of the manner in which the bag 10 operates to provide its waterproof protection.

Figure 4F:
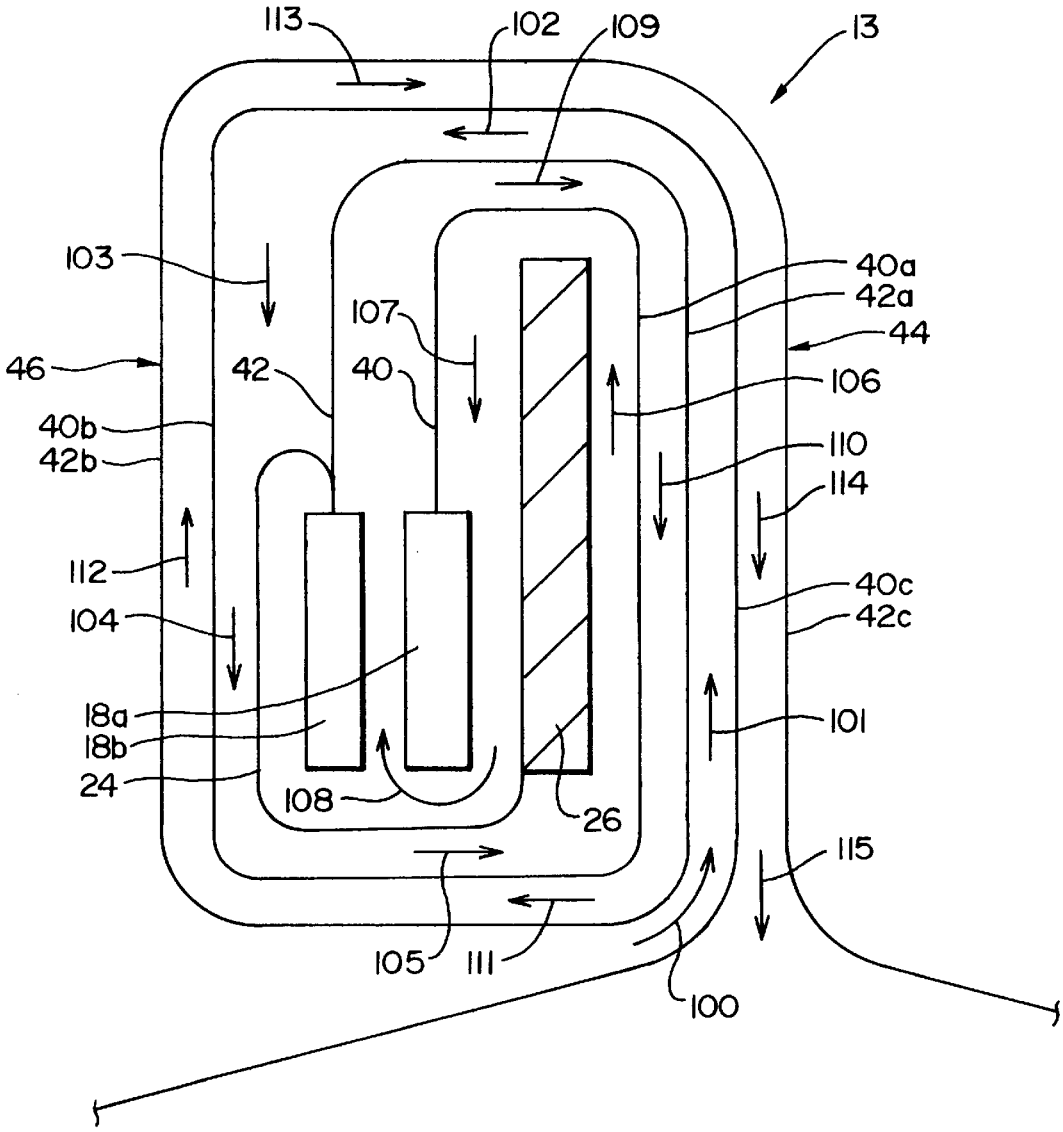
FIG. 4F is a view of the same as FIG. 4E, except drawn to a much larger scale, and also showing the flow path of any moisture that would tend to migrate through the closure section into the interior of the bag.
Figure 5:
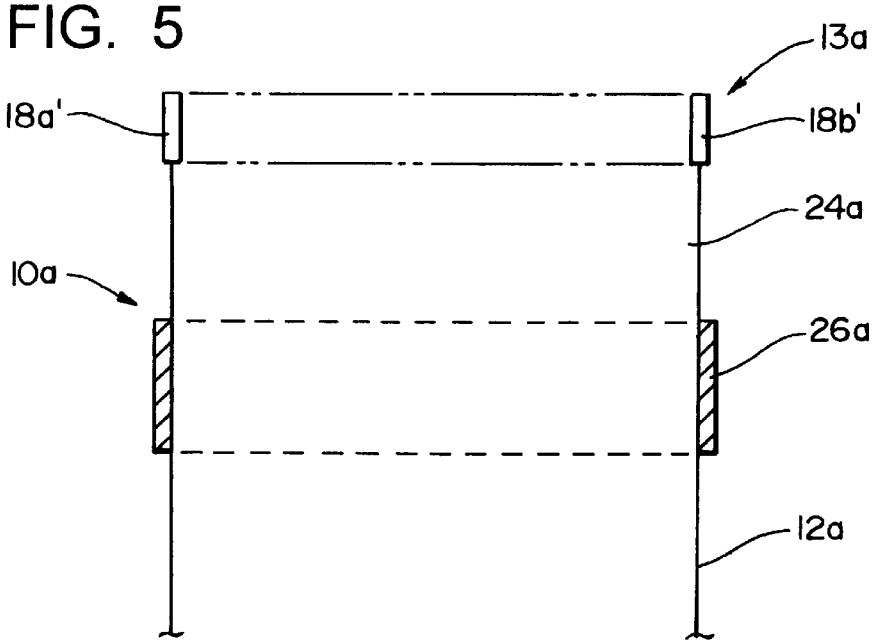
FIG. 5 is a rather schematic drawing, substantially the same as FIG. 4A, showing a second embodiment of the bag, where the closure strip or belt has been positioned at a lower location.

To explain this, reference is made to FIG. 4F, which is the same as FIG. 4E, except that it is enlarged by four times.

It should be kept in mind that each of the wall sections shown as a straight line in FIG. 4F is made up of the three layers, with the intermediate layer being a waterproof layer 36. Let us assume that the bag 10 is immersed in water. With the entire containing section of the bag being enclosed by the waterproof intermediate layer 36, the only way that water can enter is through the closure section 13.

With reference to FIG. 4F, one possible path through the closure section 13 is at the location of the arrow 100, where the two wall sections 40C and 42A come into contact with one another. It should be remembered that after the belt 26 and the various bag wall portions are folded over one another and then looped around into the closed configuration, the material on the outside of the loop is placed in tension, and thus the wall sections are pressed against one another. Also, the wall portions, which are on the inside of the loop, are in compression so that the inner wall portions press outwardly. The effect of this is that the various wall sections as seen in FIG. 4F are all pressing against on another.

To trace the possible flow route of moisture, again with reference to FIG. 4F, the entryway is at the location of the arrow 100, and then the moisture would have to travel along the path indicated by the arrows 102–107 until the moisture would come to the location of the curved arrow 108. At this point, the moisture would have reached the location of the adjacent upper perimeter edge portions 18*a* and 18*b* which are pressed against one another. Then, the moisture would begin traveling the path along arrows 109–114, with the arrow 14 indicating an entryway into the bag interior at the location of the arrow 115.

There is another possible course for the water to enter into the interior of the containing section 112, and this is that the water could leak in at the edge portions where the folds are made in the folded portion 46. Thus, some of the moisture may find a partial shortcut by entering into the fold location the arrow 108 in FIG. 4F and then come directly to the entryway of the two edge portions 18A and 18B that are presses against one another. However after reaching this location, it is necessary for the moisture to migrate through the passageway as indicated by the arrows 109–115.

Another configuration of the bag is shown in FIGS. 5 and 6A–6C. Components of this second embodiment which are similar to the earlier embodiment will be given like numerical designations, with an "a" suffix distinguishing those of the second embodiment. To further distinguish this second embodiment, the edge portions 18*a* and 18*b* have been given a prime (') designation after "18*a*" and "18*b*".

Figure 6A:
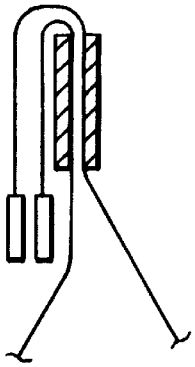
FIGS. 6A–6C are drawn similar to FIGS. 4B–4D, showing sequentially the initial steps in closing the bag of FIG. 5.
Figure 6B:
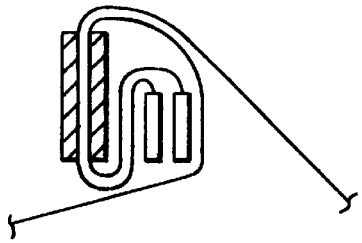
Figure 6C:
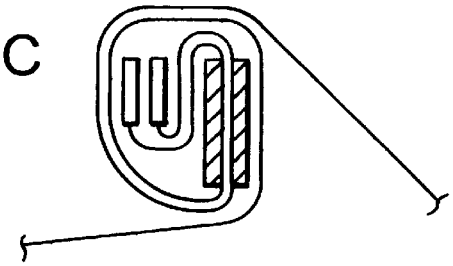

Thus, we can see that there is a bag 10*a* having a main containing section, 12*a* and a closer section 13*a*. The manner in which the closer is accomplished is substantially the same as described with respect to the first embodiment, except that the fold locations are somewhat different due to the positioning of the closure belt or strip 26*a* at a lower location. The steps in the closure are shown in FIGS. 6A–6C, and it is believed that the manner in which this is done is evident from the prior description with regard to FIGS. 4A–4F. The folding that has occurred at FIG. 6C could be carried on possibly one or two folds further to add further layers of wall portions in the folded configuration.

Figure 7:
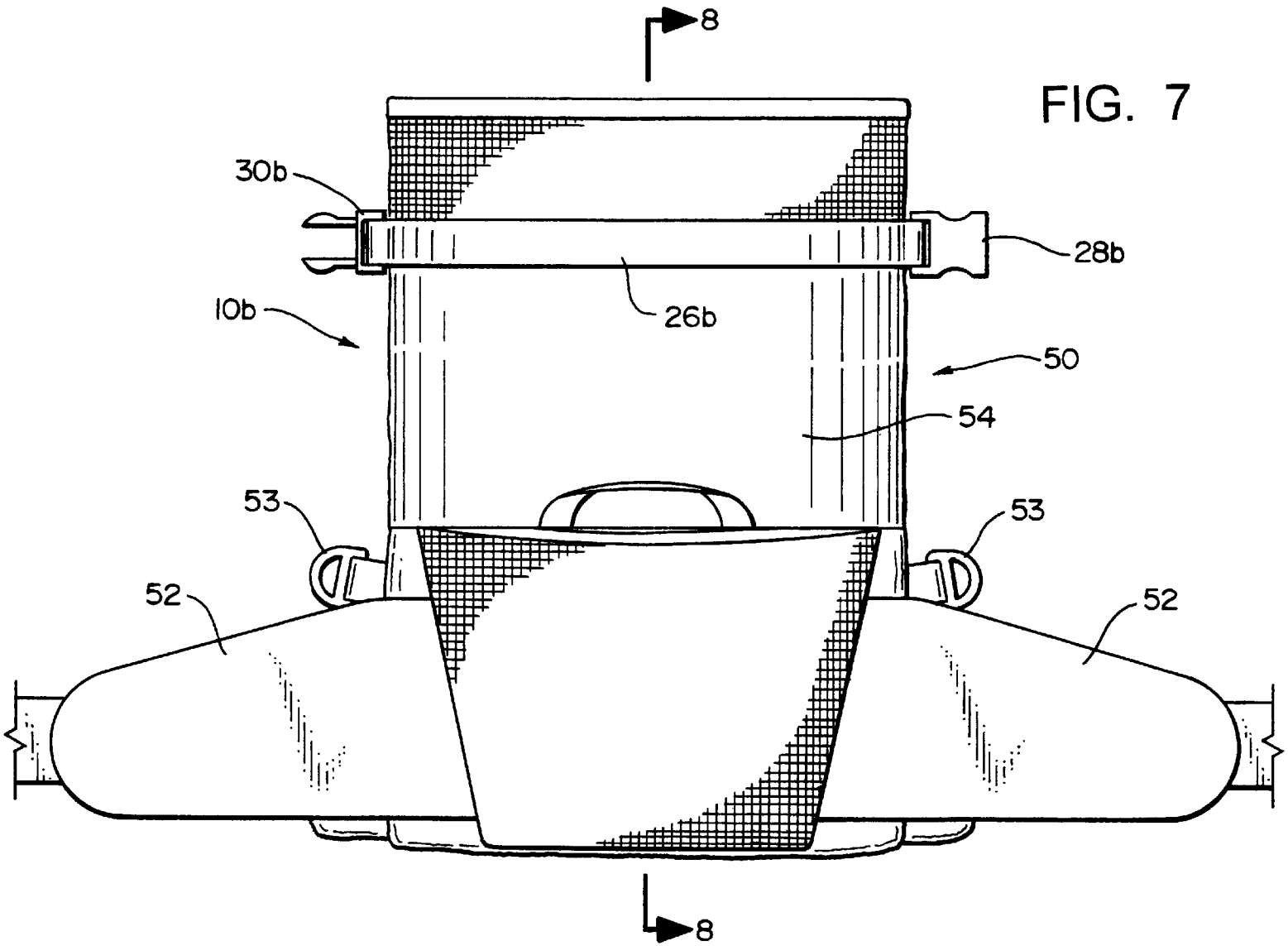
FIG. 7 is a front elevational view of a third embodiment where the bag is incorporated as the containing portion of a backpack.
Figure 8:
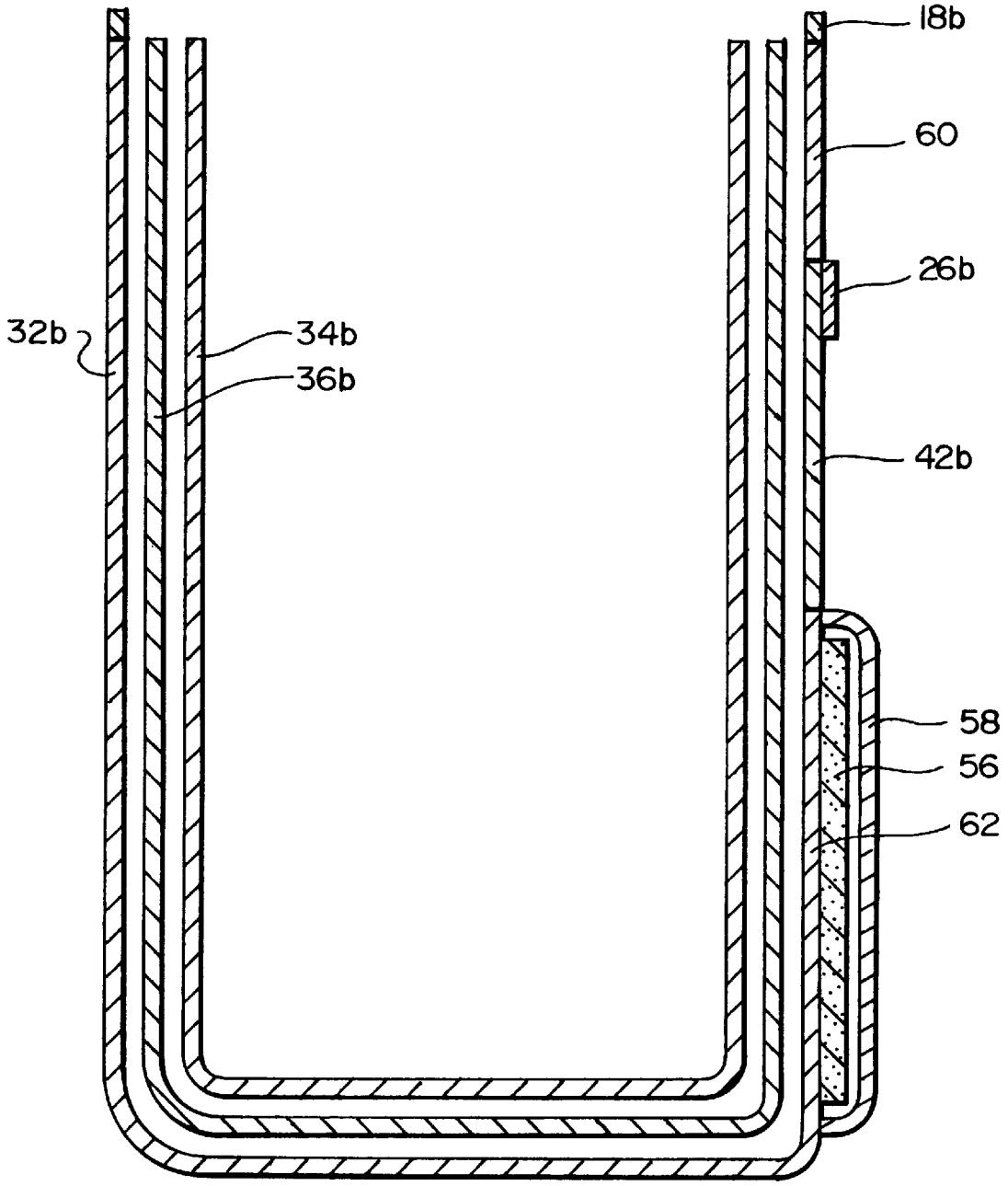
FIG. 8 is a sectional view taken along line 8-a to FIG. 7, showing in section the components of the bag somewhat schematically for purposes of illustration.

FIGS. 7 and 8 show yet a further embodiment of the present invention where the bag 10 is incorporated in a backpack.

To distinguish this embodiment, components which are similar to the prior embodiments will be given like numerical designations, and a "B" suffix will be used to distinguish those of this third embodiment. With reference to FIG. 7, there is shown the backpack 50 which comprises the bag or containing portion 10*b*. The container 10*b* is made substantially larger than the bags 10 and 10*a* from the first two embodiments and this bag is provided with a pair of waste straps 52 and some attaching loops 53. The surface 54 is a surface that is positioned adjacent to the person's back, and the lower portion of this surface 54 there is provided a foam pad 56 held in place by a wicking foam holder or cover 58. Also, side pockets or other pockets can be sewn into the outer layer 32*b* and also can be sewn into the inner layer 34*b*. The intermediate waterproof layer 36*b* is the same as in the prior two embodiments, and the upper edge portions of can be joined in the same manner as in the first embodiment.

The closure strip or belt 26*b* is positioned at a somewhat lower location, as in the second embodiment, and there are attaching buckles 28*b* and 30*b*.

There is an additional feature in the third embodiment in that at the back wall 42*b*, there is an upper open mesh fabric portion 60 that extends from the belt or strip 26B up to the upper edge 18B. This is a 9 oz. mesh and has air openings which permit the air to pass freely through the mesh portion 60.

Also, at the lower part of the back wall 42*b* there is an additional wall portion of 9 oz. open mesh designated 62, and this also has openings to permit the free passage of air.

When the backpack 50 becomes exposed to or immersed in water, the water is able to move through the mesh portions 60 and 62. However, since these are on the outside of the waterproof layer 36B, the moisture does not enter into the interior of the container 10B. The mesh portions 60 and 62 permit the moisture to drain out from between the layers 32*b* and 36*b*, and also permit the circulation of air to dry out this area.

This alleviates the problem that sometimes the water will gradually leak into the area between the outer layer 32B and the waterproof layer 36B and remain there for an extended period of time. It has been found that the arrangement shown in FIGS. 7 and 8 alleviates this problem.

It is to be recognized that various modifications could be made to the present invention without departing from the basic teachings thereof.

What is claimed is:

1. A waterproof container unit particularly adapted for use in camping and backpacking or the like, but also being adapted for use in other situations or activities where the container is subjected to impacts, sharp objects and other forms of abuse, said container unit comprising:

a) a flexible container comprising three separately formed bag components, each of which has an upper edge portion, with the upper edge portions of the three bag components being joined to one another with portions of the three bag components below the upper edge portions being substantially unjoined from one another, so that substantial regions of the bag components are separate from one another, said three bag components comprising:

i) an outer flexible and durable first bag component at an exterior surface of the container;

ii) an inner flexible and durable second bag component positioned within the first bag component at an inner surface of the container;

iii) an intermediate water proof third bag component positioned between the first and second bag components;

b) said three bag components collectively comprising a container wall comprising a side wall portion and a bottom wall portion closing the side wall portion, said side portion having an upper container edge portion defining an upper container opening;

c) said container wall comprising a lower containing wall section defining a containing chamber and an upper closure wall section comprising front and rear upper wall portions that can be positioned against one another, said closure wall section comprising a plurality of closure wall sub-sections extending along the upper closure wall section, with adjacent sub-sections being capable of one being folded downwardly relative to another about an intermediate folding portion so as to be in a folding configuration where interior surface portions of the front and rear upper wall portions press against one another in sealing relationship;

d) a closure retaining device having a retaining position to retain the closure wall subsections in their folded configuration.

2. The container unit of claim 1, wherein other objects are attached to either the first outer component, the second inner component, or both the first and second components.

3. The container unit as recited in claim 2, wherein said other objects are attached by sewing to either the first or second component or both the first and second components.

4. The container unit as recited in claim 3, wherein said objects comprise an auxiliary container member, strap, pockets, cover, partition, or other backpacking and/or camping accessories.

5. The container unit as recited in claim 2, wherein said objects comprise an auxiliary container member, strap, pockets, cover, partition, or other backpacking and/or camping accessories.

6. The container unit as recited in claim 1, wherein said closure retaining device comprises a belt extending across a part of the closure section, said belt being arranged so that it can be folded over within the closure section, and the strap ends moved towards each other to be connected to one another in a loop.

7. The containing unit as recited in claim 6, wherein said belt is a moderately stiff member.

8. The container unit as recited in claim 6, wherein said first component comprises an upwardly positioned portion having air openings and a lower positioned portion having air openings permitting flow of air from outside into an area between the first outer component and the intermediate component.

9. The containing unit as recited in claim 1, wherein said first outer component comprises a wall section which has openings to let flow of air into an area between the first component and the intermediate component.

10. The container unit as recited in claim 1, wherein the upper edges of the three bag components are sewn together at upper edge portions thereof.

11. The container unit as recited in claim 10, wherein there is an upper binding strip, which is folded along its length to have two sides positioned on opposite sides of the upper edge portions of the three components so as to enclose the upper edge portion of the three components.

12. The container unit as recited in claim 11, wherein the sides of the binding strip are sewn so as to sew the upper edge portions of the three components and the two sides of the binding strip together.

13. The container unit as recited in claim 1, wherein there is an upper binding strip, which is folded along its length to have two sides positioned on opposite sides of the upper edge portions of the three components so as to enclose the upper edge portion of the three components.

14. A waterproof container unit particularly adapted for use in camping and backpacking or the like, but also being used for other situations or activities, said container unit comprising:

a) a flexible container comprising a container wall comprising a side wall portion and a bottom wall portion closing the side wall portion, said side portion having an upper edge portion defining an upper container opening;

b) said container wall comprising three layers, each of which has an upper edge portion, the upper edge portions of the three layers being joined to one another, said three layers comprising:

i) an outer flexible and durable first layer at an exterior surface of the container;

ii) an inner flexible and durable second layer at an inner surface of the container;

iii) an intermediate water proof third layer positioned between the first and second layers;

c) said container wall comprising a lower containing wall section defining a containing chamber and an upper closure wall section comprising front and rear upper wall portions that can be positioned against one another, said closure wall section comprising a plurality of closure wall sub-sections extending along the upper closure wall section, with adjacent sub-sections being capable of one being folded downwardly relative to another about an intermediate folding portion so as to be in a folding configuration where interior surface portions of the front and rear upper wall portions press against one another in sealing relationship;

d) a closure retaining device having a retaining position to retain the closure wall subsections in their folded configuration;

e) said three bag layers being sewn together at the upper edge portions thereof.

15. The container unit of claim 14, wherein other objects are attached to either the first outer layer, the second inner layer, or both the first outer layer and the second inner layer.

16. The container unit as recited in claim 15, wherein said objects comprise auxiliary container members, straps, covers, or other backpacking and/or camping accessories.

17. At The container unit as recited in claim 14, wherein said closure retaining device comprises a belt extending across a part of the closure section, said belt being arranged so that it can be folded over within the closure section, and the strap ends moved towards each other to be connected to one another in a loop.

18. The containing unit as recited in claim 17, wherein said belt is a moderately stiff member.

19. The containing unit as recited in claim 14, wherein said first outer layer comprises a wall section which has openings to let flow of air into an area between the first layer and intermediate layer.

20. The container unit as recited in claim 19, wherein said first layer comprises an upwardly positioned portion having air openings and a lower positioned portion having air openings permitting flow of air from outside into an area between the first outer layer and the intermediate layer.

21. The container unit as recited in claim 1, wherein there is an upper binding strip, which is folded along its length to have two sides positioned on opposite sides of the upper edge portions of the three layers so as to enclose the upper edge portion of the three layers.

22. The container unit as recited in claim 21, wherein the sides of the binding strip are sewn so as to sew the upper edge portions of the three layers and the two sides of the binding strip together.

* * * * *